US011154099B2

(12) United States Patent
Harris

(10) Patent No.: US 11,154,099 B2
(45) Date of Patent: Oct. 26, 2021

(54) ARTICLE OF APPAREL HAVING ENHANCED MOBILITY

(71) Applicant: NIKE, Inc., Beaverton, OR (US)

(72) Inventor: Donavan Harris, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 527 days.

(21) Appl. No.: 15/486,705

(22) Filed: Apr. 13, 2017

(65) Prior Publication Data

US 2017/0295862 A1 Oct. 19, 2017

Related U.S. Application Data

(60) Provisional application No. 62/323,909, filed on Apr. 18, 2016.

(51) Int. Cl.
*A41D 13/00* (2006.01)
*A41D 27/24* (2006.01)
(Continued)

(52) U.S. Cl.
CPC ..... *A41D 13/0015* (2013.01); *A41B 1/08* (2013.01); *A41D 1/04* (2013.01); *A41D 27/24* (2013.01);
(Continued)

(58) Field of Classification Search
CPC ..... A41D 13/0015; A41D 1/04; A41D 27/24; A41D 2400/38; A41D 2600/10; A41B 1/00; A41B 1/08
(Continued)

(56) References Cited

U.S. PATENT DOCUMENTS 236,989 A * 1/1881 Copp ..... A41D 1/04 2/92
509,327 A 11/1893 Rew
(Continued)

FOREIGN PATENT DOCUMENTS

CN 201115434 Y 9/2008
CN 202456464 U 10/2012
(Continued)

OTHER PUBLICATIONS

International Search Report and Written Opinion dated Jul. 27, 2017 in International Patent Application No. PCT/US2017/027670, 15 pages.
(Continued)

*Primary Examiner* — Alissa J Tompkins
*Assistant Examiner* — Brieanna Szafran
(74) *Attorney, Agent, or Firm* — Shook, Hardy & Bacon LLP

(57) ABSTRACT

An article of apparel comprising a first panel joined to a second panel such that a neck opening, a right arm opening, a left arm opening, and a waist opening are formed, and a midline plane extends through the article of apparel from one side to the other and through at least the neck opening, right arm opening, and left arm opening to define an anterior portion and a posterior portion of the article of apparel. In some aspects, the first panel extends from the anterior portion to the posterior portion proximate to the neck opening. In other aspects, the second panel extends to the anterior portion inferior to the right arm opening and left arm opening to a right seam and a left seam, respectively.

17 Claims, 3 Drawing Sheets

(51) Int. Cl.
*A41B 1/08* (2006.01)
*A41D 1/04* (2006.01)

(52) U.S. Cl.
CPC ..... *A41D 2400/38* (2013.01); *A41D 2600/10* (2013.01)

(58) Field of Classification Search
USPC ..... 2/115; D2/840, 717
See application file for complete search history.

(56) References Cited

U.S. PATENT DOCUMENTS

| | | | | | |
|---|---|---|---|---|---|
| 841,824 | A * | 1/1907 | Sweet | A41D 1/06 | 2/227 |
| 1,721,403 | A * | 7/1929 | Miller | A41B 1/00 | 2/122 |
| 2,585,142 | A * | 2/1952 | Levitt | A41D 1/04 | 2/105 |
| D266,540 | S * | 10/1982 | Nacinovich | D2/738 | |
| 5,014,360 | A * | 5/1991 | Smith | A41D 31/12 | 2/115 |
| 5,704,071 | A * | 1/1998 | Barclay | A41D 1/089 | 2/238 |
| 7,356,851 | B2 * | 4/2008 | Spruill | A41D 1/04 | 2/69 |
| 7,568,966 | B2 | 8/2009 | Abbey et al. | | |
| D615,279 | S * | 5/2010 | Savage | D2/731 | |
| D661,464 | S * | 6/2012 | Wilson | D2/738 | |
| D674,166 | S * | 1/2013 | Wilson | D2/738 | |
| D674,579 | S * | 1/2013 | Grabowski | D2/849 | |
| D713,130 | S * | 9/2014 | Boyle | D2/849 | |
| D732,270 | S * | 6/2015 | Murphy | D2/717 | |
| D799,796 | S * | 10/2017 | Harris | D2/840 | |
| D800,996 | S * | 10/2017 | Harris | D2/731 | |
| D801,008 | S * | 10/2017 | Harris | D2/840 | |
| D801,635 | S * | 11/2017 | Kositchiranant | D2/731 | |
| D806,363 | S * | 1/2018 | de Oraa | D2/840 | |
| D811,043 | S * | 2/2018 | Carey | D2/728 | |
| D825,147 | S * | 8/2018 | Lomax | D2/840 | |
| D867,724 | S * | 11/2019 | Nordin, Jr. | D2/840 | |
| 2007/0294801 | A1 * | 12/2007 | Furgerson | A41D 1/04 | 2/115 |
| 2010/0218298 | A1 * | 9/2010 | Stattelmann | A41H 3/04 | 2/69 |
| 2011/0296580 | A1 * | 12/2011 | Demarest | A41D 13/0015 | 2/69 |
| 2012/0266353 | A1 * | 10/2012 | Ferre | A41D 13/0012 | 2/125 |
| 2013/0104280 | A1 * | 5/2013 | Boynton | A63B 23/12 | 2/79 |
| 2014/0338091 | A1 * | 11/2014 | Kenney | A41D 27/24 | 2/69 |
| 2015/0208734 | A1 | 7/2015 | Callahan | | |
| 2017/0295856 | A1 * | 10/2017 | Gosse | A41D 27/245 | |

FOREIGN PATENT DOCUMENTS

| | | | |
|---|---|---|---|
| CN | 203262836 | U | 11/2013 |
| CN | 203860478 | U | 10/2014 |
| CN | 204742661 | U | 11/2015 |
| JP | H08113801 | A | 5/1996 |
| JP | 2014208917 | A | 11/2014 |

OTHER PUBLICATIONS

International Preliminary Report on Patentability dated Nov. 1, 2018 in International Patent Application No. PCT/US2017/027670, 9 pages.

Intention to Grant received for European Patent Application No. 17722201.5, dated Jan. 7, 2020, 6 pages.

* cited by examiner

ARTICLE OF APPAREL HAVING ENHANCED MOBILITY

CROSS-REFERENCE TO RELATED APPLICATIONS

This application claims priority to pending U.S. Provisional Application No. 62/323,909, filed Apr. 18, 2016, titled "Article of Apparel Having Enhanced Mobility," having Attorney Docket Number NIKE.254703/160170US01, the entire contents of which are hereby incorporated by reference.

FIELD

This disclosure is directed to an article of apparel having improved shoulder and upper arm mobility characteristics.

BACKGROUND

Sleeveless and tank-style garments are utilized in various contexts to provide increased mobility to and moderate the body temperature of a wearer. For example, basketball jerseys are often constructed as sleeveless or tank-style garments. Some styles of sleeveless and tank-style garments are constructed from two panels of fabric joined at seams extending along the midline of the garment up the sides between the waist opening and arm openings and between the arm openings and neck opening. These styles of sleeveless and tank-style garments include various drawbacks, such as restricted range-of-motion, which may limit the ability of the wearer to fully extend his or her arms back or up. In addition, these styles of sleeveless and tank-style garments are limited to integrating vents along the seam on the side of the garment in an area not usually associated with movement of the wearer resulting in the vents remaining closed. These are only some of the exemplary issues presented by some typical sleeveless and tank-style garments.

BRIEF DESCRIPTION OF THE DRAWINGS

Examples of the present invention are described in detail below with reference to the attached drawing figures, wherein.

DETAILED DESCRIPTION

Figure 1:
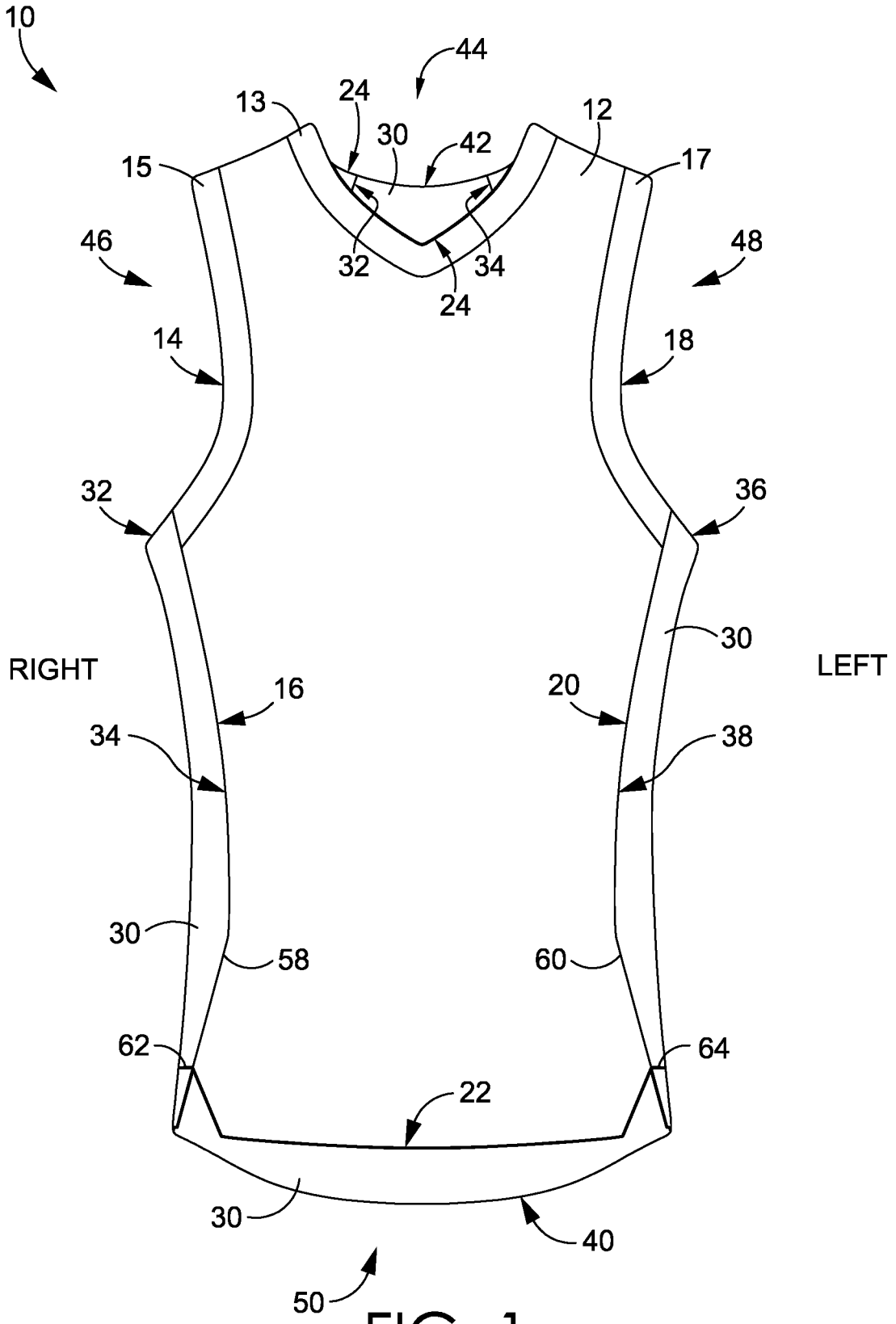
FIG. 1 illustrates a front elevation view of an exemplary article of apparel in accordance with an aspect provided herein.

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are equivalent to the ones described in this disclosure. In other words, the intended scope of the claims, and the other subject matter described in this specification, includes equivalent features, materials, methods of construction, and other aspects not expressly described or depicted in this application in the interests of concision, but which would be understood by an ordinarily skilled artisan in the relevant art in light of the full disclosure provided herein as being included within the inventive scope. It will be understood that certain features and subcombinations are of utility and may be employed without reference to other features and subcombinations. This is contemplated by and is within the scope of the claims.

Throughout this description, the term "as-worn position" will be used when discussing the orientation of the disclosed article of apparel. The as-worn position of the article of apparel denotes the position the article of apparel is in when donned by a wearer. Hence, in the as-worn position, a shirt will be oriented such that a neck opening will be at the top of the shirt and near the upper end of the wearer's torso. Similarly, in the as-worn position, the shirt will be oriented such that a waist opening will be at the bottom of the shirt and near the waist of the wearer. However, the subject matter is described in an as-worn position merely to assist the reader in understanding relative terminology and should not be implied to require a human being (or other living being) to understand or interpret the subject matter of this disclosure.

As used throughout this disclosure, the terms "securing" or "affixing" mean either releasably or permanently attaching objects together using affixing technologies such as stitching, bonding, welding, hook-and-loop fasteners, buttons, snaps, and the like.

At a high level, the present invention provides an article of apparel comprised of a first panel joined to a second panel to form a neck opening, a right arm opening, a left arm opening, and a waist opening. The article of apparel may be divided into an anterior portion and a posterior portion by a midline plane extending through the article of apparel and intersecting at least the neck opening, the right arm opening and the left arm opening. In some aspects, the first panel may be positioned at the anterior portion and the second panel may be positioned at the posterior portion except that part of the first panel may extend into the posterior portion proximate to the neck opening and that part of the second panel may extend into the anterior portion inferior to the right arm opening and left arm opening. The first panel may be joined to the second panel inferior to the right arm opening at a right seam and inferior to the left arm opening at a left seam. The right seam and the left seam may each be in the anterior portion. The first panel may also be joined to the second panel proximate to the neck opening at a right shoulder seam and at a left shoulder seam. The right shoulder seam and the left shoulder seam may each be in the posterior portion. A narrowest distance between the right arm opening and the left arm opening may be smaller in the posterior portion than in the anterior portion allowing the wearer a greater range of motion when lifting his or her arms up or extending them back. Further, the right seam and the left seam may terminate superior to the waist opening to allow the unjoined portions of the first panel and the second panel to form a vent inferior to each seam. Positioning the vents at the anterior portion may align them with a portion of the wearer associated with movement of the wearer resulting in the vents opening as the wearer moves (for example, the vents may open as the wearer lifts his or her legs to run).

Figure 2:
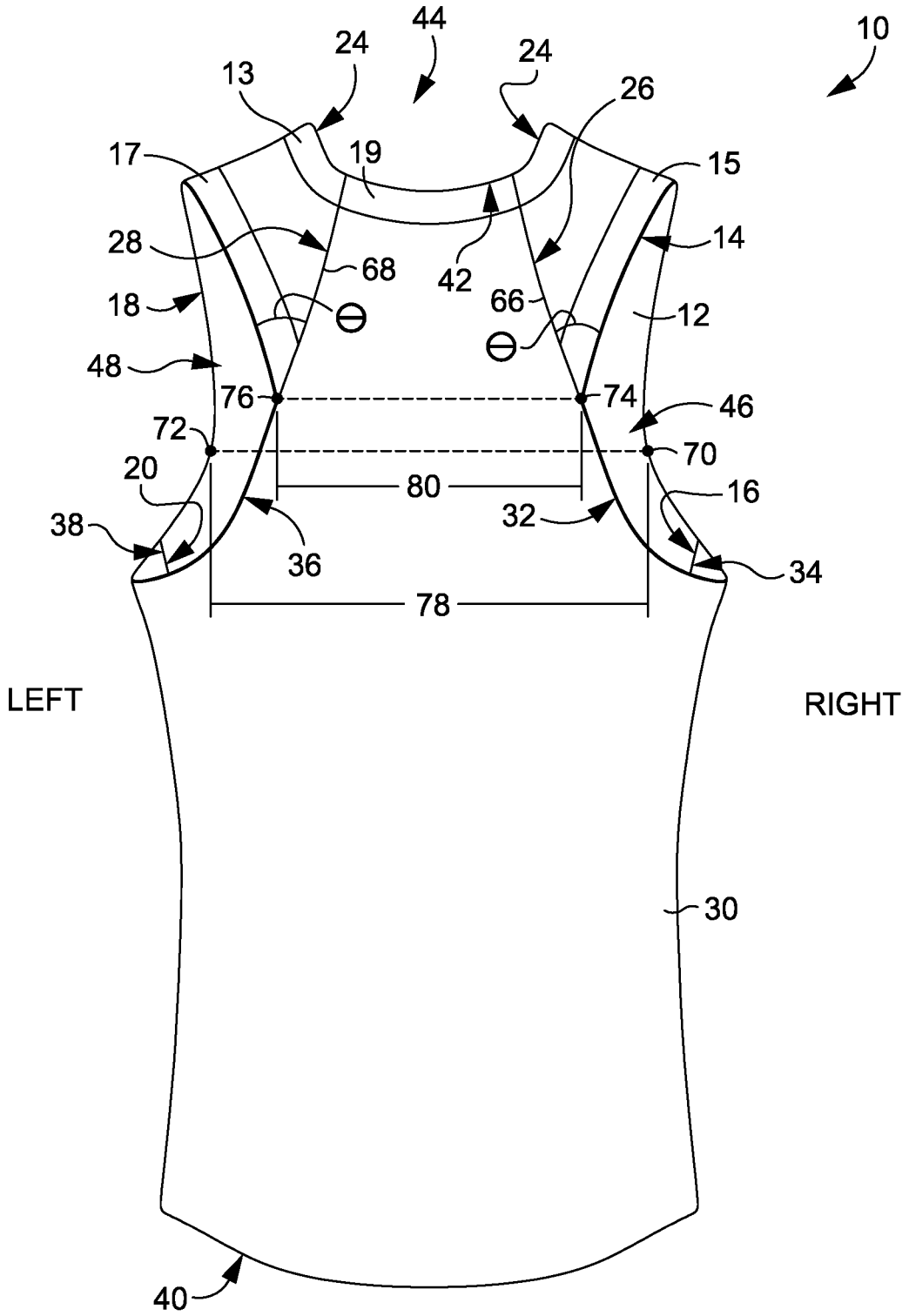
FIG. 2 illustrates a back elevation view of the exemplary article of apparel of FIG. 1 in accordance with an aspect provided herein.
Figure 3:
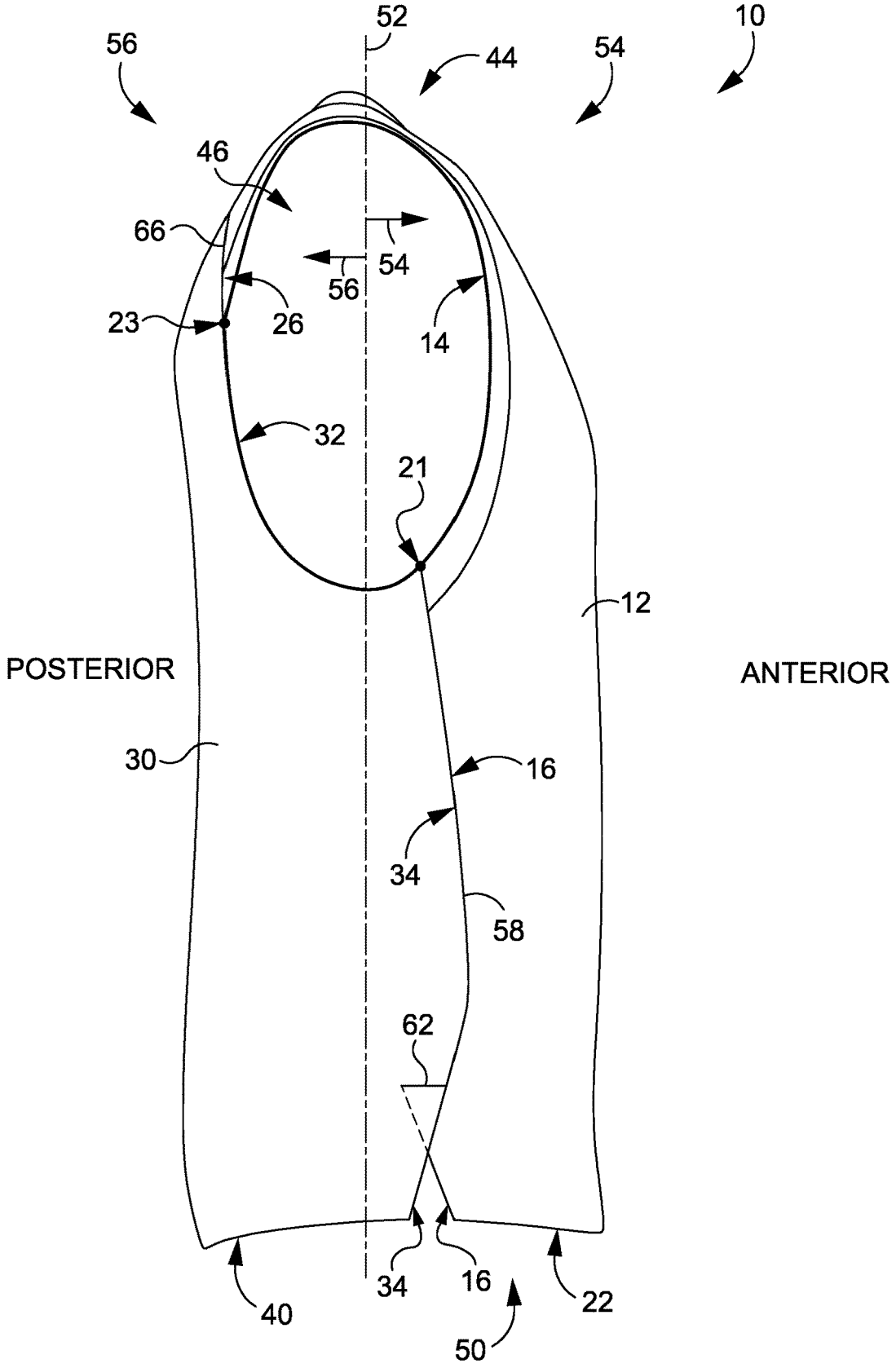
FIG. 3 illustrates a right side elevation view of the exemplary article of apparel of FIG. 1 in accordance with an aspect provided herein.

Referring now to FIGS. 1-3, a front elevation, rear elevation and right side elevation depict an article of apparel 10, in accordance with aspects hereof. As depicted herein, the article of apparel 10 may be a shirt. For example, the article may be a sleeveless shirt for use in connection with a sporting activity, such as basketball, that includes arm movements that benefit from greater mobility. For example, in a basketball shooting motion, the player may raise his or her arms above their head during the shooting action. This superior movement of the arms may benefit from enhanced shoulder and arm mobility provided by the article of apparel 10. Further, continuing with the basketball theme, a player may position his or her arms above their head and extend the arms in a posterior direction in preparation to pass or throw a ball. As the arms in this example may have a range of motion extending from the posterior to anterior portions of the player's body, an enhanced shoulder and arm movement article of apparel may be advantageous. While the previous examples focus on basketball, it is contemplated that an article of apparel having features provided herein may be implemented in connection with any activity that may benefit from enhanced shoulder movement and/or thermal regulation.

The article of apparel 10 may comprise a first panel 12 joined to a second panel 30. In some aspects, each of the first panel 12 and the second panel 30 may comprise unitary panels of fabric. In other aspects, the first panel 12 and/or the second panel 30 may be formed from a plurality of sub-panels. For example, the first panel 12 may include a trim piece (e.g., trim piece 13, 15, and/or 17) secured to one or more of the first panel 12 edges. Each of the first panel 12 and the second panel 30 may be woven, knit, non-woven fiber, and/or sheet-like. For example, the panels may be constructed from any material (e.g., textile).

The first panel 12 may include a first right edge 14, a second right edge 16, a first left edge 18, a second left edge 20, an inferior edge 22, a superior edge 24, a posterior right edge 26, and a posterior left edge 28. The second panel 30 may include a first right edge 32, a second right edge 34, a first left edge 36, a second left edge 38, an inferior edge 40, and a superior edge 42. It is understood that in aspects where the first panel 12 and/or the second panel 30 are formed from a plurality of sub-panels, each of the edges referred to above refers to the exterior edge (e.g., outer perimeter) of the composite panel formed from the plurality of sub-panels. For example, where the second panel 30 includes a major sub-panel and a trim piece 19 affixed along the superior edge of the major sub-panel (as shown in FIG. 2) the second panel 30 includes both the major sub-panel and the trim piece 19. Continuing such example, the second panel superior edge 42 refers to the free edge of the trim piece 19 forming the neck opening 44 (as shown in FIG. 2).

The first panel 12 may be joined to the second panel 30 such that a neck opening 44, a right arm opening 46, a left arm opening 48 and a waist opening 50 are formed. In some aspects, the neck opening 44 may be formed by the first panel superior edge 24 and the second panel superior edge 42. In other aspects, the neck opening 44 may be formed by at least the first panel superior edge 24 and the second panel superior edge 42.

The right arm opening 46 may be formed by the first panel first right edge 14 and the second panel first right edge 32. Likewise, the left arm opening 48 may be formed by the first panel first left edge 18 and the second panel first left edge 36. In some aspects, the right arm opening 46 may be formed by at least the first panel first right edge 14 and the second panel first right edge 32. In other aspects, the left arm opening 48 may be formed by at least the first panel first left edge 18 and the second panel first left edge 36. A first edge and a second edge may form a continuous edge where the first is superior to the second. Furthermore, it is contemplated that a first edge and a second edge may transition at an opening, a feature of the panel, or other geometric variation. For example, if a continuous edge includes an angular change, a first edge may be located at a superior location of the angular change and a second edge may be located inferior to the angular change. Other variations in a panel edge may guide where a first and second edge originate and/or terminate.

The waist opening 50 may be formed by the first panel inferior edge 22 and the second panel inferior edge 40, according to aspects described herein. In other aspects, the waist opening 50 may be formed from at least the first panel inferior edge 22 and the second panel inferior edge 40. For example, the waist opening 50 may be formed by the first panel inferior edge 22, the second panel inferior edge 40, the first panel second right edge 16, the first panel second left edge 20, the second panel second right edge 34, and the second panel second left edge 38.

Referring to FIG. 3, the article of apparel 10 may be divided by a midline plane 52 into an anterior portion 54 and a posterior portion 56. The anterior portion 54 may be defined by a direction normal to the midline plane 52, while the posterior portion 56 may be defined by an opposite second direction normal to the midline plane 52. For example, when the article of apparel 10 is in the as-worn position the anterior portion may refer to a front portion of the article and the posterior portion may refer to a rear (e.g., back) portion of the article. In some aspects, the midline plane 52 may extend through the neck opening, the right arm opening, and the left arm opening when the article of apparel 10 is in the as-worn position. In other aspects, the midline plane 52 may bisect the article of apparel 10 dividing the article evenly between the anterior portion 54 and the posterior portion 56. In still other aspects, the midline plane 52 may be forward or rearward of center making one of the anterior portion 54 or the posterior portion 56 of the article of apparel 10 larger than the other.

The first panel 12 may be positioned at the anterior portion 54 and the second panel 30 may be positioned at the posterior portion 56. In some aspects, portions of the first panel 12 may extend into the posterior portion 56 proximate to the neck opening 44. In other aspects, portions of the second panel 30 may extend into the anterior portion 54 inferior to the right arm opening 46, the left arm opening 48, or both the right arm opening 46 and the left arm opening 48. The first panel 12 may form a portion of the anterior portion 54 and/or a portion of the posterior portion 56, in exemplary aspects.

In one aspect, the neck opening 44 may be formed by the first panel superior edge 24 at the anterior portion 54 and by both the first panel superior edge 24 and the second panel superior edge 42 at the posterior portion 56.

In some aspects, the first panel first right edge 14 may converge with the first panel second right edge 16 at the right arm opening 46 and the first panel first left edge 18 may converge with the first panel second left edge 20 at the left arm opening 48. In other aspects, the second panel first right edge 32 may converge with the second panel second right edge 34 at the right arm opening 46 and the second panel first left edge 36 may converge with the second panel second left edge 38 at the left arm opening 48. The two right edges and the two left edges of either the first panel 12 or the second panel 30 may converge at the anterior portion 54.

The right arm opening 46 and the left arm opening 48 may be formed by joining the first panel first right edge 14 to the second panel first right edge 32 at two locations and by joining the second panel first left edge 36 to the first panel first left edge 18 at two locations. In some aspects, the second panel first right edge 32 may be joined to the first panel first right edge 14 at a location 21 on the anterior portion 54 and at a location 23 on the posterior portion 56. Similarly, the second panel first left edge 36 may be joined to the first panel first left edge at the anterior portion 54 and at the posterior portion 56.

Referring back to FIG. 1, the first panel 12 may be joined to the second panel 30 at a right seam 58 and a left seam 60. In some aspects, the right seam 58 may join the first panel second right edge 16 to the second panel second right edge 34. In other aspects, one or more of the first panel second right edge 16 and the second panel second right edge 34 may overlap one another and extend beyond the right seam 58. Similarly, the left seam 60 may join the first panel second left edge 20 and the second panel second left edge 38. In yet other aspects, one or more of the first panel second left edge 20 and the second panel second left edge 38 may overlap one another and extend beyond the left seam 60.

The first panel 12 may also be joined to the second panel 30 at a right lateral seam 62 and a left lateral seam 64. Each of the right lateral seam 62 and the left lateral seam 64 may partially extend circumferentially around the article of apparel 10, when in the as-worn position. For example, in aspects where the first panel second right edge 16 overlaps the second panel second right edge 34, the right lateral seam 62 may extend from the second panel second right edge 34 to the first panel second right edge 16 when the first panel 12 and the second panel 30 overlap at the right lateral seam 62. In other aspects, the right lateral seam 62 may extend beyond the first panel second right edge 16 towards the posterior portion 56. In some aspects, the left lateral seam 64 may be configured as a mirror image of the right lateral seam 62. For example, in aspects where the first panel second left edge 20 overlaps the second panel second left edge 38, the left lateral seam 64 may extend from the second panel second left edge 38 to the first panel second left edge 20.

The right seam 58 may extend inferior from the right arm opening 46, in accordance with aspects described herein. In some aspects, the right seam 58 may extend from a location inferior to the right arm opening 46 to the right lateral seam 62. Likewise, the left seam 60 may extend inferior from the left arm opening 48 to the left lateral seam 64. In other aspects, the right seam 58 may extend to a location inferior to or superior to the right lateral seam 62. Likewise, the left seam 60 may extend to a location inferior to or superior to the left lateral seam 64. The right lateral seam 62 and the left lateral seam 64 may provide additional support to help prevent the article of apparel 10 from tearing apart at the right seam 58 and left seam 60, respectively.

A portion of the first panel 12 may overlap a portion of the second panel 30 at each of the right lateral seam 62 and the left lateral seam 64. For example, as shown in FIG. 3 a portion of the first panel 12 overlaps a portion of the second panel 30 such that at least a portion of the first panel second right edge 16 is positioned nearer the posterior portion than at least a portion of the second panel second right edge 34 at the right lateral seam 62. In aspects, the first panel 12 and the second panel 30 may overlap one another inferior to the right lateral seam 62. In some aspects, each of the first panel second right edge 16 and the second panel second right edge 34 may freely extend inferior to the right lateral seam 62 to the first panel inferior edge 22 and the second panel inferior edge 40, respectively. In other aspects, the first panel second right edge 16 and the second panel second right edge 34 may taper away from one another as they extend towards the first panel inferior edge 22 and the second panel inferior edge 40, respectively, to form a right vent. In aspects, the left side of the article of apparel 10 may be a mirror image of the right side of the article of apparel 10 as described above.

In some aspects, the right seam 58 and the left seam 60 are each positioned at the anterior portion 54. In further aspects, the first panel second right edge 16, the first panel second left edge 20, the second panel second right edge 34, the second panel second left edge 38, the right lateral seam 62, and the left lateral seam 64 may each be positioned, in addition to the right seam 58 and the left seam 60, at the anterior portion 54. In still further aspects, any vents formed by overlapping, tapering edges of the first panel 12 and the second panel 30 may also be positioned in the anterior portion 54.

Returning to FIG. 2, the first panel 12 may be positioned at the anterior portion 54 and may extend into the posterior portion 56 such that the first panel posterior right edge 26 and the first panel posterior left edge 28 are joined to the second panel at the posterior portion 56. In some aspects, the first panel posterior right edge 26 may be joined to the second panel first right edge 32 and the first panel posterior left edge 28 may be joined to the second panel first left edge 36.

In other aspects, the article of apparel 10 may include a right shoulder seam 66 and a left shoulder seam 68. The right shoulder seam 66 may extend from the neck opening 44 to the right arm opening 46 (e.g., the location 23 of FIG. 3) Likewise, the left shoulder seam 68 may extend from the neck opening 44 to the left arm opening 48. Each of the right shoulder seam 66 and the left shoulder seam 68 may be positioned at the posterior portion 56, in accordance with some aspects.

The right shoulder seam 66 may join the first panel posterior right edge 26 to the second panel 30. For example, the first panel posterior right edge 26 may be affixed to the second panel first right edge 32 at the right shoulder seam 66. Similarly, the left shoulder seam 68 may join the first panel posterior left edge 28 to the second panel 30. For example, the first panel posterior left edge 28 may be affixed to the second panel first left edge 36 at the left shoulder seam 68.

In some aspects, an angle θ presented between the first panel first right edge 14 and the first panel posterior right edge 26 may be an acute angle, as depicted in FIG. 2. In other aspects, the angle θ presented between the first panel first left edge 18 and the first panel posterior left edge 28 may also be an acute angle.

In the as-worn position, the first panel first right edge 14 may have a most centered (e.g., nadir location on a curved portion of the first left edge 18) anterior point 70 and the first panel first left edge 18 may have a most centered anterior point 72 and a distance 78 between anterior points 70, 72 may be the shortest distance between the first panel first right edge 14 and the first panel first left edge 18 at the anterior portion 54. Similarly, the first panel first right edge 14 may have a most centered posterior point 74 and the first panel first left edge 18 may have a most centered posterior point 76 and a distance 80 between them may be the shortest distance between the first panel first right edge 14 and the first panel first left edge 18 in the posterior portion 56. In some aspects, the distance 78 is larger than the distance 80 and may allow for increased mobility of the wearer in the upper arm and shoulder area.

While the left side elevation is not depicted, it is contemplated in an exemplary aspect that the left side mirrors elements and features of the right side elevation of FIG. 3, in an exemplary aspect. However, it is contemplated that alternative configurations may exist. For example, a lateral seam, arm opening, seam length, edge configuration, and the like may be different between a right side and a left side to accommodate a different dominant hand/side for a wearer. For example, a right-handed shooter in basketball may have a different mobility scenario with a right arm than a left arm, in an exemplary aspect. As such, the right side and the left side may be constructed with differing characteristics, in an exemplary aspect.

Some aspects of this disclosure have been described with respect to the illustrative examples provided by FIGS. 1-3. Additional aspects of the disclosure will now be described that may related subject matter included in one or more claims of this application, or one or more related applications, but the claims are not limited to only the subject matter described in the below portions of this description. These additional aspects may include features illustrated by FIGS. 1-3, features not illustrated by FIGS. 1-3, and any combination thereof. When describing these additional aspects, reference may or may not be made to elements depicted by FIGS. 1-3.

In one exemplary aspect, this disclosure is directed to an article of apparel comprising a first panel joined to a second panel. Each of the first panel and the second panel may have at least a superior edge, a first right edge, a second right edge, a first left edge, and a second left edge. The first panel may be joined to the second panel to form a neck opening, a right arm opening, and a left arm opening. For example, the neck opening may be defined, at least in part, by the first panel superior edge and the second panel superior edge. Similarly, the right arm opening may be defined, at least in part, by the first panel first right edge and the second panel first right edge. Likewise, the left arm opening may be defined, at least in part, by the first panel first left edge and the second panel first left edge. A midline plane may extend through the neck opening, the right arm opening, and the left arm opening when the article of apparel is in the as-worn position. A first direction normal to the midline plane may define an anterior portion of the article of apparel. An opposite second direction normal to the midline plane may define a posterior portion of the article of apparel. A right seam may extend inferior to the right arm opening at the anterior portion and a left seam may extend inferior to the left arm opening at the anterior portion. The right seam and the left seam may join the first panel and the second panel. The second panel may be positioned at the posterior portion except the second panel may extend to the right seam and the left seam at the anterior portion. The first panel may be positioned at the anterior portion except that the first panel may extend to the posterior portion of the article of apparel proximate to the neck opening.

In another exemplary aspect, this disclosure is directed to an article of apparel comprising a first panel joined to a second panel. Each of the first panel and the second panel may have at least a superior edge, a first right edge, and a first left edge. In addition, the first panel may also include a posterior right edge and a posterior left edge. The first panel may be joined to the second panel to form a neck opening, a right arm opening, and a left arm opening. For example, the neck opening may be defined, at least in part, by the first panel superior edge and the second panel superior edge. Similarly, the right arm opening may be defined, at least in part, by the first panel first right edge and the second panel first right edge. Likewise, the left arm opening may be defined, at least in part, by the first panel first left edge and the second panel first left edge. A midline plane may extend through the neck opening, the right arm opening, and the left arm opening when the article of apparel is in the as-worn position. A first direction normal to the midline plane may define an anterior portion of the article of apparel. An opposite second direction normal to the midline plane may define a posterior portion of the article of apparel. The first panel may be positioned at the anterior portion and may extend to the posterior portion such that the first panel posterior right edge and the first panel posterior left edge are joined to the second panel at the posterior portion.

From the foregoing, it will be seen that this subject matter is adapted to attain all the ends and objects hereinabove set forth together with other advantages, which are obvious and which are inherent to the structure. It will be understood that certain features and subcombinations are of utility and may be employed without reference to other features and subcombinations. This is contemplated by and is within the scope of the claims. Since many possible variations and alternatives may be made without departing from the scope thereof, it is to be understood that all matter herein set forth or shown in the accompanying drawings is to be interpreted as illustrative and not in a limiting sense.

What is claimed is:

1. An article of apparel comprising:

a first panel having a superior edge, a first right edge, a second right edge, a first left edge, a second left edge, and an inferior edge;

a second panel having a superior edge, a first right edge, a second right edge, a first left edge, a second left edge, and an inferior edge;

a neck opening defined, at least in part, by the first panel superior edge and the second panel superior edge;

a right arm opening defined, at least in part, by the first panel first right edge and the second panel first right edge;

a left arm opening defined, at least in part, by the first panel first left edge and the second panel first left edge;

a midline plane, the midline plane extending through the neck opening, the right arm opening, and the left arm opening when the article of apparel is in the as-worn position, wherein a first direction normal to the midline plane defines an anterior portion of the article of apparel and an opposite second direction normal to the midline plane defines a posterior portion of the article of apparel;

a right seam extending inferior to the right arm opening at the anterior portion, the right seam joining the first panel and the second panel;

a left seam extending inferior to the left arm opening at the anterior portion, the left seam joining the first panel and the second panel;

a right lateral seam extending from the right seam towards the posterior portion; and a left lateral seam extending from the left seam towards the posterior portion, wherein the right seam extends in an inferior direction from the right arm opening to the right lateral seam, wherein the left seam extends in an inferior direction from the left arm opening to the left lateral seam, wherein the first panel second right edge and the second panel second right edge extend freely from the right lateral seam in an inferior direction towards the first panel inferior edge and the second panel inferior edge, respectively, wherein the first panel second left edge and the second panel second left edge extend freely from the left lateral seam in an inferior direction towards the first panel inferior edge and the second panel inferior edge, respectively, wherein the first panel extends to the posterior portion of the article of apparel proximate to the neck opening, and wherein the second panel second right edge overlaps the first panel second right edge inferior to the right lateral seam, and wherein the second panel second left edge overlaps the first panel second left edge inferior to the left lateral seam.

2. The article of apparel of claim 1, wherein the first panel first right edge converges with the first panel second right edge at the right arm opening, and wherein the first panel first left edge converges with the first panel second left edge at the left arm opening.

3. The article of apparel of claim 1, wherein the second panel first right edge converges with the second panel second right edge at the right arm opening, and wherein the second panel first left edge converges with the second panel second left edge at the left arm opening.

4. The article of apparel of claim 1, wherein the right seam joins the first panel second right edge and the second panel second right edge, and wherein the left seam joins the first panel second left edge and the second panel second left edge.

5. The article of apparel of claim 1, wherein the second panel first right edge is coupled to the first panel first right edge in both the anterior portion and the posterior portion, and wherein the second panel first left edge is coupled to the first panel first left edge in both the anterior portion and the posterior portion.

6. The article of apparel of claim 5, wherein the second panel first right edge is coupled to the first panel first right edge in the anterior portion at the right seam, and wherein the second panel first left edge is coupled to the first panel first left edge in the anterior portion at the left seam.

7. The article of apparel of claim 6, further comprising:

a right shoulder seam extending between the neck opening and the right arm opening at the posterior portion, the right shoulder seam joining the first panel and the second panel; and a left shoulder seam extending between the neck opening and the left arm opening at the posterior portion, the left shoulder seam joining the first panel and the second panel.

8. The article of apparel of claim 1, wherein the right lateral seam extends towards the posterior portion from the second panel second right edge to the first panel second right edge, and wherein the left lateral seam extends towards the posterior portion from the second panel second left edge to the first panel second left edge.

9. The article of apparel of claim 1, further comprising:

a waist opening defined, at least in part, by the first panel inferior edge and the second panel inferior edge.

10. The article of apparel of claim 9, wherein the second panel second right edge overlaps the first panel second right edge superior to the first panel inferior edge and the second panel inferior edge.

11. An article of apparel comprising:

a first panel having a superior edge, a first right edge, a posterior right edge, a first left edge, a posterior left edge, a second right edge, a second left edge, and an inferior edge;

a second panel having a superior edge, a first right edge, a posterior right edge, a first left edge, a posterior left edge, a second right edge, a second left edge, and an inferior edge;

a neck opening defined, at least in part, by the first panel superior edge and the second panel superior edge;

a right arm opening defined, at least in part, by the first panel first right edge and the second panel first right edge;

a left arm opening defined, at least in part, by the first panel first left edge and the second panel first left edge;

a midline plane, the midline plane extending through the neck opening, the right arm opening, and the left arm opening when the article of apparel is in the as-worn position, wherein a first direction normal to the midline plane defines an anterior portion of the article of apparel and an opposite second direction normal to the midline plane defines a posterior portion of the article of apparel;

a right seam extending in an inferior direction from the right arm opening to a right lateral seam;

a left seam extending in an inferior direction from the left arm opening to a left lateral seam, wherein the right lateral seam extends from the right seam towards the posterior portion, wherein the left lateral seam extends from the left seam towards the posterior portion, wherein the first panel posterior right edge is joined to the second panel at the posterior portion, wherein the first panel posterior left edge is joined to the second panel at the posterior portion, wherein the first panel second right edge and the second panel second right edge extend freely from the right lateral seam in an inferior direction towards the first panel inferior edge and the second panel inferior edge, respectively, wherein the first panel second left edge and the second panel second left edge extend freely from the left lateral seam in an inferior direction towards the first panel inferior edge and the second panel inferior edge, respectively, and wherein the second panel second right edge overlaps the first panel second right edge inferior to the right lateral seam, and wherein the second panel second left edge overlaps the first panel second left edge inferior to the left lateral seam.

12. The article of apparel of claim 11, further comprising:

a right shoulder seam extending between the neck opening and the right arm opening at the posterior portion, the right shoulder seam joining the first panel and the second panel; and a left shoulder seam extending between the neck opening and the left arm opening at the posterior portion, the left shoulder seam joining the first panel and the second panel.

13. The article of apparel of claim 12, wherein the right shoulder seam joins the first panel posterior right edge to the second panel first right edge, and wherein the left shoulder seam joins the first panel posterior left edge to the second panel first left edge.

14. The article of apparel of claim 11, wherein the second panel first right edge is coupled to the first panel first right edge in both the anterior portion and the posterior portion, and wherein the second panel first left edge is coupled to the first panel first left edge in both the anterior portion and the posterior portion.

15. The article of apparel of claim 11, wherein a smallest distance between the right arm opening and the left arm opening at the posterior portion is smaller than a smallest distance between the right arm opening and the left arm opening at the anterior portion.

16. The article of apparel of claim 11, wherein the neck opening is defined only by the first panel superior edge at the anterior portion and wherein the neck opening is defined in part by the first panel superior edge and in part by the second panel superior edge at the posterior portion.

17. The article of apparel of claim 11, wherein the angle formed between the first panel first right edge and the second panel first right edge at the posterior portion is an acute angle, and wherein the angle formed between the first panel first left edge and the second panel first left edge at the posterior portion is an acute angle.

* * * * *